United States Patent [19]

Masuda et al.

[11] 4,085,057

[45] Apr. 18, 1978

[54] TONER FOR ELECTROSTATIC PRINTING OF SHEET LIKE MATERIALS CONTAINING TRIAZINE ANTISTATIC AGENT

[75] Inventors: Yougoro Masuda, Takatsuki; Shigeru Kawase, Nara, both of Japan

[73] Assignee: Kanebo Ltd., Tokyo, Japan

[21] Appl. No.: 659,561

[22] Filed: Feb. 19, 1976

[30] Foreign Application Priority Data

Feb. 21, 1975 Japan ..... 50-22235

[51] Int. Cl.[2] ..... G03G 9/08

[52] U.S. Cl. ..... 252/62.1 P; 8/2.5 R; 96/1 SD; 544/194; 544/195; 544/211; 544/213

[58] Field of Search ..... 252/62.1 P; 96/1 SD; 260/248 R, 249.8, 249.5; 8/2.5 R

[56] References Cited

U.S. PATENT DOCUMENTS

| | | | |
|---|---|---|---|
| 3,202,681 | 8/1965 | Dexter et al. | 260/249.5 |
| 3,507,864 | 4/1970 | Joyce et al. | 260/248 R |
| 3,527,746 | 9/1970 | Canonica et al. | 260/249.5 |
| 3,574,229 | 4/1971 | Pizzarello et al. | 260/248 R |
| 3,669,922 | 6/1972 | Bartsch et al. | 252/62.1 P |
| 3,700,662 | 10/1972 | Ishikawa et al. | 260/249.8 |

*Primary Examiner*—Ralph S. Kendall
*Assistant Examiner*—John D. Smith
*Attorney, Agent, or Firm*—Kenyon & Kenyon

[57] ABSTRACT

A toner for the electrostatic printing of a sheet like material, which comprises a toner substrate consisting essentially of a resin and a coloring matter, and a triazine derivative applied to the surface of or incorporated in the toner substrate.

6 Claims, No Drawings

TONER FOR ELECTROSTATIC PRINTING OF SHEET LIKE MATERIALS CONTAINING TRIAZINE ANTISTATIC AGENT

The invention relates to a toner for the electrostatic printing of a sheet like material. More particularly, the invention relates to a toner comprising a triazine derivative, which is particularly useful for electrostatically printing a textile material.

Recently, techniques such as electrophotography, electrostatic electrography and the like have been greatly developed and, thus, many attempts have been made to apply such techniques to other technical fields. For example, there has been proposed so called electrostatic printing wherein a toner image which may be obtained by various methods, such as electrophotography, for example xerography or electrofax, electrostatic recording, or electrostatic printing, for example xeroprinting or electrostatic gravure printing, or TESI technique, is transfered utilizing electrostatic force, directly or through a printing medium, to a paper or textile fabric or the like.

The toner to be used in such electrostatic printing generally consists of a fine powder of a blend of a synthetic resin such as a styrene, acrylic or epoxy resin or a natural resin such as rosin or dammar and a coloring matter such as dye or pigment. In the improved toner, specific resins and coloring matters are used in a specific amount or a third material is added. However, the use of a known toner gives unsatisfactory printings, because the printings result in low build-up, fog and non-uniformity of color. Particularly, in the electrostatic printing of textile fabrics, it has been very difficult to obtain satisfactory results due to the unevenness and non-smoothness of the surface, and high porocity of the fabric.

It is, therefore, an object of the present invention to provide a novel toner for electrostatic printing which is durable in repeated printing and capable of being applied to a textile fabric easily, uniformly and in high build-up without any staining of the fabric.

Another object of the invention is to provide a toner superior in the coverage upon development, as well as superior in transference and uniform transferability upon transfer.

A further object of the invention is to provide a toner which can be used, without any trouble, for cross printing to obtain a multicolor effect or as a blend of toners containing different coloring matter.

Additional objects of the invention will become apparent from the following description.

The invention provides a toner for the electrostatic printing of a sheet like material, which comprises a toner substrate consisting essentially of a resin and a coloring matter, and a triazine derivative applied to the surface of or incorporated in the toner substrate.

The term "toner substrate" as used herein, refers to a composition comprising at least one resin and at least one coloring matter. The toner substrate may further comprise conventional additives such as iron powder, dyeing aids and finishing agents.

Resins such as those which are conventionally used in the art are usable for the toner substrate and they include, for example, homopolymers and copolymers of monoethylenically unsaturated monomers such as ethylene, propylene, vinyl chloride, vinyl acetate, styrene, aminostyrene, methyl methacrylate and butyl methacrylate, and the modified polymers such as polyvinyl formal as well as their mixtures. In addition, polycarbonates and ethyl cellulose as well as polyacrylamide and polyvinyl alcohol are also usable. Particularly, resins based on the styrene monomers and the methacrylate monomers, and the polycarbonates or the modified resins can suitably be employed.

The exact nature of the coloring matter is not critical to the invention. Examples of the coloring matters are disperse dyes such as Diacelliton Fast Scarlet R (Misubishi Kasei Co., C. I. 11150), Miketon Fast Pink FF3B (Mitsui Toatsu Co., C. I. 62015), Celliton Fast Yellow RR (BASF Co., C. I. 10345), Miketon Fast Orange GR (Mitsui Toatsu Co., C. I. 11005), Kayalon Fast Scarlet B (Nippon Kayaku Co., C. I. 11110), Diacelliton Red R M/D (Mitsubishi Kasei Co., C. I. 11210), Celliton Fast Violet B (BASF Co., C. I. 62030), Cibacet Blue F3R (Ciba-Geigy Co., C. I. 61505), Miketon Fast Turquoise Blue G (Mitsui Toatsu Co., C. I. 62500) and Kayalon Diazo Black B (Nippon Kayaku Co., C. I. 11365); acid dyes such as Suminol Fast Yellow R (Sumitomo Kagaku Co., C. I. 18835), Coomassie Fast Orange G (I.C.I. Co., C. I. 24780), Kayaku Acid Red 3B (Nippon Kayaku Co., C. I. 24810), Acid Violet 5B (C. I. 42640), Diacid Light Blue 2A (Mitsubishi Kasei Co., C. I. 62055), Alizarine Fast Green G (Ciba-Geigy Co., C. I. 61570) and Supranol Fast Black VLG (Bayer Co., C. I. 27070); basic dyes such as Sumiacryl Orange G (Sumitomo Kagaku Co., C. I. 48035), Auramine extra O-125 (Sumitomo Kagaku Co., C. I. 41000), Astrazon Pink FG (Bayer Co., C. I. 48015), Diabasic Magenta (Mitsubishi Kasei Co., C. I. 42510), Serron Blue 5G (E. I. Dupont Co., C. I. 51005) and Aizen Cathilon Grey BLH (Hodogaya Kagaku Co., C. I. 11825); direct dyes such as Direct Fast Yellow GC (Mitsui Toatsu Co., C. I. 2900), Benzo Scarlet GS (Bayer Co., C. I. 29165), Diacotton Violet X (Mitsubishi Kasei Co., C. I. 22550), Direct Blue 2B (Nippon Kayaku Co., C. I. 22610), Sumilight Supra Brown G (Sumitomo Kagaku Co., C. I. 36200) and Direct Fast Black AB (Mitsubishi Kasei Co., C. I. 35440); reactive dyes such as Procion Blue H-B (I.C.I. Co., C. I. 61211), Diamira Golden Yellow G (Mitsubishi Kasei Co., C. I. 18852), Procion Brilliant Yellow H-5G (I.C.I. Co., C. I. 18972), Cibacron Brilliant Orange G-E (Ciba-Geigy Co., C. I. 17865), Mikacion Rubine BS (Nippon Kayaku Co., C. I. 17965), Cibacron Violet F2R-A (Ciba-Geigy Co., C. I. 18157), Cibacron Brown 3GR-A (Ciba-Geigy Co., C. I. 26440) and Procion Black H-G (I.C.I. Co., C. I. 17916); Oilsluble dyes such as Zapon Fast Yellow CGG (BASF Co., C. I. 18820), Diaresin Red J (Mitsubishi Kasei Co., C. I. 12715), Victoria Blue F4R (BASF Co., C. I. 42563) and Nigrosine Base GB (Bayer Co., C. I. 50415), and; pigments such as Brilliant Carmine 3B (C. I. 16015), Benzidine Yellow G (C. I. 21090), Benzidine Orange (C. I. 21110), Lake Red 4R (C. I. 12120), Permanent Carmine FB (C. I. 12490), Fanal Violet R supra (C. I. 42535), Phthalocyanine Blue (C. I. 74160), Fanal Green G Supra (C. I. 42040), Permanent Brown FG (C. I. 12480), Diamond Black (C. I. 50440), zinc white (C. I. 77947), titanium white (C. I. 77891) and carbon black (C. I. 77265).

The triazine derivatives usable for the invention regulate the accumulation of static electricity onto the toner. In other words, the triazine derivative acts to conduct and diffuse the electrical charge accumulated, or to limit the yield of the electrical charge, and thus, limits the retention of the electrical charge on the toner. Preferred triazine derivatives are those which have an electrification factor of from 100 to 2,000, particularly from 200 to 1,500.

The term "electrification factor" as used herein, refers to an absolute value of the surface potential determined as follows. A test sample is prepared by forming polystyrene, blended with 2% by weight of a triazine derivative to be tested, into a sheet of a 30 $\mu$ thickness on an aluminum foil. The test sample is intermittently subjected to positive corona discharge of a leakage current of 2.8 $\mu$A, in the case where the antistatic agent is to be employed in a positively charged toner, or to negative corona discharge of a leakage current of 2.8 $\mu$A, in the case where it is to be employed in a negatively charged toner, for 20 seconds in total under conditions of 20° C and 65% RH. Then, the surface potential of the test sample is determined.

Examples of the usable triazine derivatives are those of the formulae,

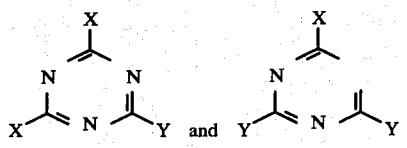

wherein X is halogen, Y is a radical of the formula

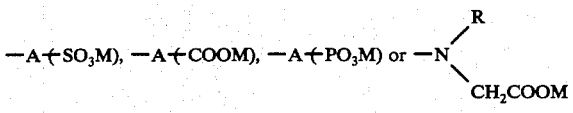

wherein A is $-NH(CH_2)_m$, $-CH_3N(CH_2)_m$,

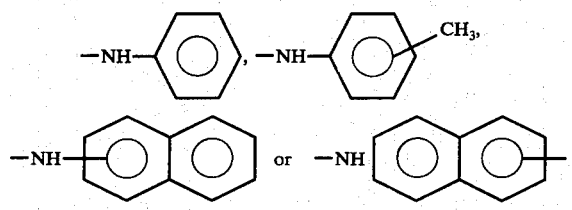

OH, R is hydrogen or alkyl having 1 to 18 carbon atoms, M is hydrogen or an alkali metal atom, and $m$ is an integer of 1 to 5.

The triazine derivatives of the above formulae may be prepared, in a known manner, by reacting cyanuric halide with a member selected from the group consisting of sulfonic acids such as taurine, methyltaurine, aniline-sulfonic acid, phenolsulfonic acid, toluidinesulfonic acid, toluidinedisulfonic acid, anilinedisulfonic acid, naphthionic acid, 1-naphthylamine-3,6-disulfonic acid, Koch's acid, H-acid, 1-naphthylamine-3,7-disulfonic acid, Cleve's 7-acid, Cleve's 8-acid, amino R-Acid, $\gamma$ -disulfonic acid, RM-acid tar acids, M-acid, amino J-acid, Tobias' acid and phenoldisulfonic acid and their alkali metal salts; carboxylic acids such as glycine, phenylglycine, aminobenzoic acid, aminobutyric acid, aminocaproic acid, aminopropionic acid and aminophthalic acid and their alkali metal salts, and; phosphoric acids such as aminomethanephosphonic acid, hydroxymethanephosphonic acid, aminoethylphosphonic acid, aminobutylphosphonic acid and aniline phosphonic acid and their alkali metal salts.

The reaction may conveniently be carried out using approximately 1 or 2 mols of an acid or its salt as mentioned above per mol of cyanuric halide, in the presence of an acid binding agent, in an aqueous, organic or aqueous-organic medium at 0° to 5° C. Where different groups Y are to be introduced, the reaction may be carried out in two steps. At the second step, the reaction may conveniently be carried out at 20° to 40° C. As the organic medium, for example, acetone, methyl ethyl ketone and dioxane are preferred and as the acid binding agent, for example, potassium and sodium hydroxides, potassium and sodium carbonates, calcium, magnesium and barium hydroxides, and sodium acetate and bicarbonate are conveniently employed.

Representatives of the triazine derivatives are exemplified below.

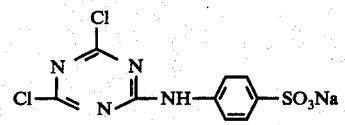

(I)

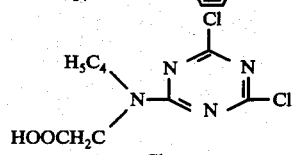

(II)

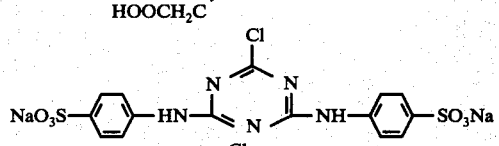

(III)

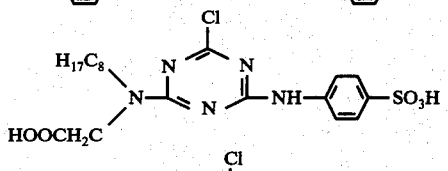

(IV)

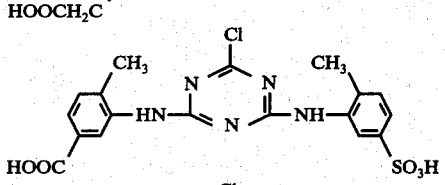

(V)

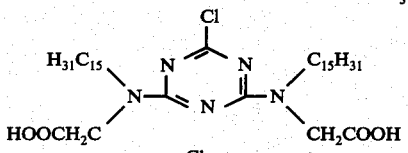

(VI)

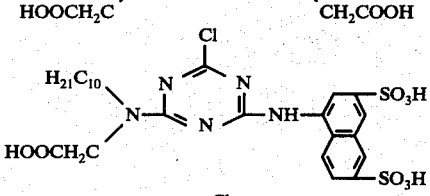

(VII)

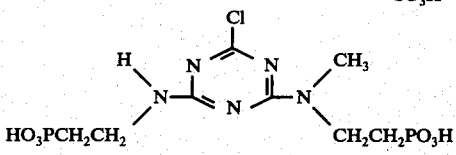

(VIII)

The following are synthesis examples of the triazine derivatives.

SYNTHESIS EXAMPLE 1

A solution of 18.5 g (0.1 mol) of cyanuric chloride in 40 cc of acetone was poured into 100 g of ice-water with vigorously stirring to form fine dispersion. While maintaining at 0° to 5° C by external cooling, a 50% aqueous solution of 18.8 g (0.1 mol) of N-octylaminomethane carboxylic acid was slowly added dropwise to the dispersion, during which time the pH was maintained at 8 to 9 by dropping 2N solution of sodium carbonate. The dropwise addition of N-octylaminomethane carboxylic acid was continued for 2 hours with stirring and the stirring was carried out for further 1 hour. Then, the pH of the reaction mixture was adjusted to 7 by adding an aqueous solution of sodium carbonate and, thereafter, the temperature was raised to 35° C. A 10% aqueous solution of 17.3 g (0.3 mol) of sulfanilic acid is then added over the course of 1 hour to adjust the pH to 5 to 6. Then, the mixture was stirred for further 1 hour and the pH was finally adjusted to 6. The obtained product was collected and sodium acetate was added to the collected product. The mixture was then stored over night and day and white precipitates thus formed were filtered. This salting-out procedure was repeated three times. The obtained product was washed and dried in vacuo. Thus, 42 g (92%) of white powder was obtained.

The obtained product was found to be of formula,

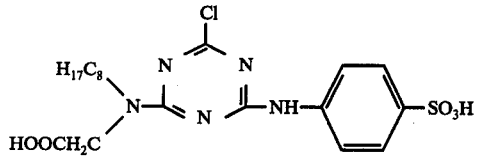

SYNTHESIS EXAMPLE 2

150 ml of distilled water was entered into a four neck flask of a volume of 1 l equipped with a stirrer, cooling tube, thermometer and dropping funnel and cooled to 5° C or below. Then, a solution of 55.2 g (0.3 mol) of cyanulic chloride in 200 ml of acetone was added with vigorously stirring to be dispersed into the distilled water. A 30% aqueous solution of 58.5 g (0.3 mol) of sodium sulfanilate was then slowly added dropwise and, thereafter an aqueous solution of sodium carbonate was added to adjust the pH to 8 to 9. The stirring was continued for further 1 hour.

Then, the temperature was raised to 40° C, a 30% aqueous solution of sodium sulfanilate was added dropwise over the course of 1 hour and then an aqueous solution of sodium hydroxide was added to adjust the pH to 7. The reaction was further continued for 1 hour.

The obtained product was collected, washed with methanol three times and then dried in vacuo. Thus, 145 g (96%) of white amorphous powder was obtained. This product was found to be of formula,

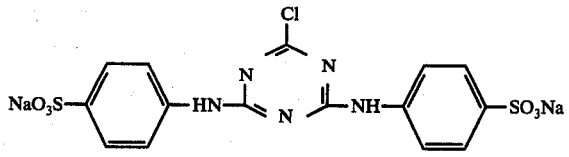

The toner according to the invention is composed of the hereinbefore mentioned toner substrate and triazine derivative, and can be classified as one of the following three types depending upon its construction. One type is a toner wherein the triazine derivative is applied to the surface of the toner substrate (hereinafter referred to as A type toner); another type is a toner wherein the triazine derivative is incorporated in the toner substrate (hereinafter referred to as B type toner), and; the other type is a blend of the A type and B type toners (hereinafter referred to as C type toner). All of these three types of toners are included in the scope of the invention and they may be prepared as follows.

A TYPE TONER

Toner substrate ingredients are dissolved and/or dispersed in a medium such as dioxane, trichlene, dimethylformamide, benzene or water. The mixture is then formulated to obtain a toner substrate in a particle or powder form, in a proper manner such as by pouring it into a non-solvent, precipitating and drying, by spray drying, by gelating it at a low temperature, grinding and drying, or by melt grinding. Then, a triazine derivative is applied to the toner substrate in a proper manner by any conventional methods. The application may conveniently be carried out, for example, by dissolving or dispersing the triazine drivative in a medium such as water, acetone or methanol, which is a non-solvent or poor solvent of the toner substrate, applying the solution or dispersion to the toner substrate by spraying or dipping, then filtering or centrifugating to a proper liquid content, and finally drying. The triazine derivative is preferably applied to the toner substrate in an amount of not less than 0.01% based on the weight of the toner substrate.

B TYPE TONER

A triazine derivative is incorporated in a toner substrate. The incorporation may conveniently be carried out, for example, by dissolving and/or dispersing the toner substrate ingredients and a triazine derivative in a proper medium such as dioxane, trichlene, dimethyl formamide, benzene or water and, then, formulating the mixture into a particle form in a proper manner as mentioned above; or by heat melting the toner substrate ingredients, blending the melt with a triazine derivative and, then, formulating the blend into a particle form by grinding. For the incorporation, any other conventional methods may also conveniently be employed. The triazine derivative is preferably incorporated in the toner substrate in an amount of not less than 0.1% based on the weight of the toner substrate.

C TYPE TONER

A toner of this type may be prepared in accordance with the procedures mentioned above for the A type and B type toners.

The toner according to the invention may optionally comprise other third materials, such as additives, and such materials may conveniently added at the time of preparation of the toner. The toner is preferably in a particle size of the less than 80 $\mu$, particularly less than 30 $\mu$, and may conveniently be classified by the fluid sizing method.

The toner may conveniently be applied to a textile fabric, such as woven, knitted or non-woven fabric, consisting of or comprising a natural fibrous material such as cotton, silk or wool; semi-synthetic fibrous material such as of viscose or cellulose acetate, and; synthetic fibrous material such as those of polyester, polyacrylonitrile or polyamide. The toner may also conveniently applied to a paper, leather, film or metallic substrates.

A toner image may be formed by a proper method of electrophotography, electrostatic printing or electrostatic recording as hereinbefore mentioned. Then, the toner image may conveniently be transferred onto the textile fabric by the known corona discharge transfer, bias transfer or repulsion transfer, and then fixed in a conventional manner.

When a textile fabric is printed using the toner of the invention, it is preferred, in view of uniformity of color, build-up and avoidance of fog and stain of the back surface, that the transfer be carried out by placing a sheet having a smooth surface such as paper or film upon the back surface of the textile fabric to be printed, or by using a textile fabric preliminarily treated with a surface active agent or water-soluble polymer to give a surface resistivity of $1\times10^6$ to $1\times10^{14}$ Ω.

The coloring matter contained in the toner thus transferred onto the fabric may be fixed by subjecting the fabric to a heat or solvent steam treatment. Alternatively, the coloring matter may be fixed by a conventional dyeing technique. If desired, the fabric may then be washed with a solvent to eliminate the resin.

The toner of the invention may also be employed to print a textile fabric by so called transfer printing using a support such as paper or film, onto which the toner is applied. Further, the toner may be employed for cross printing to obtain a multicolor effect on the printed fabric. In such a case, two or more toners containing different coloring matters of different shades may be sequentially transferred to the fabric.

The toner of the invention is excellent in coverage upon development in comparison with toners of the prior art. The known toners give a coverage of at most 0.6 to 0.7 mg/cm$^2$ and, thus, result in low build-up. If a known toner is applied in a large amount, an excess accumulation of the toner occurs and the area of the plate which is not to be covered by the toner is stained by the excess of the toner. Thus, this stain yields so called fog. However, if the toner of the invention is used, the coverage of the toner is greatly increased and, thus, a printing of high color intensity with no stain by unfixed toner can be obtained.

According to the toner of the invention, the transference of the developed toner to the material to be printed is remarkably increased. The use of the prior art toners gives a transference of only about 40%, in the transfer to a textile fabric. However, a transference of the toner of the invention of up to about 80% can be attained even in the transfer to a textile material.

Further, the toner of the invention does not stain the back surface of the printed fabric. Textile fabrics generally have a high porosity and, therefore, upon the transfer of the developed toner, the toner is passed through the pores and diffused onto the back surface of the fabric. Thus, the back surface of the printed fabric is stained by the toner passed through the pores. However, the toner of the invention does not stain the back surface of such a fabric.

Furthermore, the use of the toner of the invention results in a uniformity of color such as of intensity and tone even when two or more toners are used as a blend. However, in the use of the conventional toners, it has been difficult to obtain such uniformity of color. Particularly, when the prior art toners are used as a blend of toners containing coloring matters of different shades, printings result which are not only non-uniform in color as a whole but also of non-uniform color in portions, which portions are dotted with innumerable points of different shades.

Still further, the toner of the invention is excellent in durability in repeated printing. That is, the tone of the color of the obtained printings and the flowability of the toner are very durable in repeated printing for a long time of period.

The features of the invention will now be more distinctly illustrated by the following illustrative, but not limitative examples. In the examples, all parts are by weight. The evaluation results given in the examples were obtained as follows.

A. COLOR INTENSITY

Under the evaluation standard shown below, a five step evaluation was effected by 10 panelists skilled in the art and their evaluation values were averaged.

1: Very low in color intensity
2: Low in color intensity
3: Medium in color intensity
4: High in color intensity
5: Very high in color intensity

B. UNIFORMITY OF COLOR

Under the following standard, evaluation was carried out in the same manner as mentioned in A, above.

1: Remarkable non-uniformity observed
2: Fair non-uniformity observed
3: Some non-uniformity observed
4: Little non-uniformity observed
5: No non-uniformity observed

C. STAIN OF BACK SURFACE

Under the following standard, evaluation was carried out in the same manner as mentioned in A, above.

1: Remarkable stain observed
2: Fair stain observed
3: Some stain observed
4: Little stain observed
5: No stain observed

D. TONE OF COLOR

Under the following standard, the difference of tone of color of a sample with that of the first printed sample was evaluated in the same manner as mentioned in A, above.

1: Great remarkable difference observed
2: Remarkable difference observed
3: Fair difference observed
4: Some difference observed
5: Little difference observed

E. ANGLE OF REPOSE (FLOWABILITY)

A toner sample was charged in a transparent plastic vessel of a diameter of 5 cm and a thickness of 2 cm, up to the half volume of the vessel and the vessel was closed. The vessel was placed on a desk so that the circular sides thereof became vertical and the surface of the powder layer of the toner was horizontal. Then, the vessel was slowly rolled so that the surface of the toner layer was inclined. Thus, the angle of inclination at the time the surface of the toner layer began to slide was determined.

F. FOG

Under the following standard, evaluation was carried out in the same manner as mentioned in A, above.

1: Remarkable fog observed
2: Fair fog observed
3: Some fog observed

4: Little fog observed
5: No fog observed

EXAMPLE 1

A zinc oxide photosensitive layer was negatively and uniformly charged by corona discharge of −6000 V in the dark and, then, exposed to light through a monochromatic film of stripe-patterns to form a corresponding electrostatic latent image.

A mixture of 140 parts of amino-modified polystyrene obtained by reacting a styrene-glycidyl methacrylate copolymer with diethylamine and 40 parts of Kayaku Acid Red 3B (Nippon Kayaku Co., C.I. 24810) in 1000 parts of trichlene was spray dried to obtain powder. The powder was then classified to obtain a toner substrate of a particle size of about 10 to 25 μ. The toner substrate was then immersed into an aqueous solution of the triazine derivative of the above mentioned fomula (III), filtered and then dried in vacuo at 60° C for 3 hours. Thus, a toner was obtained.

Then, 3 parts of the toner was admixed with 97 parts of iron powder and the mixture was well blended. The latent image was developed with the blend by magnetic brush method. Thereafter, a nylon fabric was placed upon the developed surface of the photoconductive layer and the toner was transfered onto the fabric by corona discharge of −6500 V from the back surface of the fabric. Then, the toner was fixed onto the fabric by heating for 5 seconds using an infrared lamp and the dye contained in the toner was fixed by steaming at 130° C for 15 minutes. The fabric was then washed with trichlene to remove the resin.

Color intensity and uniformity of color evaluated with respect to the obtained fabric were as shown in Table 1 below. For comparison purposes, evaluation results of a fabric obtained as mentioned above but not using a triazine derivative are also shown in Table 1.

Table 1

| No. | Coverage of Triazine (%) | Color Intensity | Uniformity of Color |
|---|---|---|---|
| 1 | 0.31 | 3.9 | 4.0 |
| 2 | 1.16 | 4.0 | 4.3 |
| 3 | 4.98 | 4.4 | 4.5 |
| 4 | 10.31 | 4.5 | 4.6 |
| 5 | — | 2.4 | 2.1 |

From the above table, it is apparent that good color intensity and unfiromity of color are obtained when at least 0.01%, based on the weight of the toner substrate, of the triazine derivative is applied to the surface of the toner substrate.

A yellow shaded toner was prepared in the same manner as described above, except that Suminol Fast Yellow R (Sumitomo Kagaku Co., C.I. 18835) was used as a coloring matter.

3 parts of the red shaded toner was blended with 7 parts of the yellow shaded toner. Then, a nylon fabric was printed in the same manner as mentioned above with the toner blend. Thus, a printed fabric of orange shaded stripe patterns was obtained.

Evaluation results for the obtained fabric are shown in Table 2 below. Results obtained where no triazine derivative was used are also shown in the table.

Table 2

| No. | Coverage in Red Toner (%) | Coverage in Yellow Toner (%) | Color Intensity | Uniformity of Color |
|---|---|---|---|---|
| 1 | 0.31 | 0.30 | 4.0 | 4.1 |

Table 2-continued

| No. | Coverage in Red Toner (%) | Coverage in Yellow Toner (%) | Color Intensity | Uniformity of Color |
|---|---|---|---|---|
| 2 | 1.16 | 1.08 | 4.1 | 4.8 |
| 3 | 4.98 | 5.10 | 4.5 | 4.7 |
| 4 | 10.31 | 10.23 | 4.5 | 4.8 |
| 5 | — | — | 2.5 | 1.3 |

As is apparent from the above table, when a triazine derivative is applied, even where two toners are used as a blend, good color intensity and uniformity of color are obtained.

EXAMPLE 2

A toner was prepared in the same manner as described in Example 1, except that Cibacet Blue F3R(Ciba-Geigy Co., C.I. 61505) was used as a coloring matter and that a mixture of the resin, the dye and the triazine derivative in trichlene were spray dried to form a toner.

In the same manner as described in Example 1, a printing paper of ordinary quality, in stead of the nylon fabric, was printed with the toner. The paper had blue shaded stripe patterns printed thereon.

A polyester fabric was placed upon the printed surface of the paper and the dye contained in the toner was transfered and fixed in blue stripe patterns by heating at 200° C for 40 seconds on a pantex.

Evaluation results for the obtained fabric are shown in Table 3 below. Results obtained where no triazine derivative was used are also shown in the same table.

Table 3

| No. | Content of Triazine (%) | Color Intensity | Uniformity of Color |
|---|---|---|---|
| 1 | 2 | 4.0 | 4.0 |
| 2 | 10 | 4.3 | 4.4 |
| 3 | — | 2.3 | 2.1 |

As is seen from the above table, the use of a triazine derivative gives good color intensity and uniformity of color.

EXAMPLE 3

A photosensitive plate composed of three layers; a conductive layer of aluminum, a photoconductive layer of cadmium sulfide and an insulating layer of polyethylene terephthalate was positively and uniformly charged by corona discharge of +6000 V. The plate was then exposed to light through a monochromatic film of vertical stripe patterns and, concurrently, subjected to alternating current corona discharge of 6000V. Thereafter, the plate was uniformly exposed to light to form a latent image.

A mixture of 160 parts of a copolymer of styrene and 2-hydroxyethyl methacrylate and 40 parts of Diacelliton Red R M/D (Mitsubishi Kasei Co., C.I. 11210) in 1000 parts of methyl ethyl ketone was poured into a large amount of water to form fine particles. Then, the particles was dried and classified. Thus, a toner substrate of a particle size of about 10 to 20 μ was obtained. Then, 10 parts of the toner was immersed in 50 parts of a 2% aqueous solution of the triazine derivative of the hereinbefore mentioned formula (III) and then treated in the same manner as described in Example 1 to obtain a red toner.

A yellow toner was prepared in the same manner as described above, except that Celliton Fast Yellow RR (BASF Co., C.I. 10345) was used as a coloring matter.

3 parts of the red toner was admixed with 97 parts of iron powder and the mixture was well blended. The latent image was developed with the blend by magnetic brush method. Then, a polyester fabric was placed upon the developed surface after the developed surface was subjected to corona discharge of +6000V. The toner was transfered onto the fabric by rolling grounded rolls over the back surface of the fabric. The toner was then fixed by heating using an infrared lamp and the dye was fixed onto the fabric by steaming at 130° C, for 15 minutes. The fabric was then washed with trichlene to remove the resin. Thus, a printed fabric having red stripe patterns was obtained.

Furhter, a red printed fabric was obtained in the same manner as described above but using a polyester fabric which was pretreated as follows: the polyester fabric was imersed in a solution of 5 parts of polyoxyethylene nonylphenol ether (5 mols of ethylene oxide) in 1000 parts of trichlene squeezed by a mangle to a pick of 100% and dried at 80° C for 5 minutes.

Still further, yellow and orange printed fabrics were obtained in the same manner as described above, but using the yellow toner mentioned above and a blend of 1 part of the red toner and 2 parts of the yellow toner, respectively.

Evaluation results obtained for these fabrics are shown in Table 4 below. Results obtained where no triazine derivative was used are also shown in the table.

Table 4

| No. | Torner | Pre-treatment | Coverage of Triazine (%) | Color Intensity | Uniformity of Color |
|---|---|---|---|---|---|
| 1 | Red | None | 2.21 | 4.3 | 4.2 |
| 2 | Red | Treated | 2.21 | 4.7 | 4.6 |
| 3 | Yellow | None | 1.90 | 4.2 | 4.3 |
| 4 | Yellow | Treated | 1.90 | 4.6 | 4.7 |
| 5 | Blend | None | 2.00 (in average) | 4.3 | 4.1 |
| 6 | Blend | Treated | 2.00 (in average) | 4.6 | 4.7 |
| 7 | Red | None | — | 2.6 | 2.2 |
| 8 | Red | Treated | — | 3.8 | 3.4 |
| 9 | Yellow | None | — | 2.4 | 2.1 |
| 10 | Yellow | Treated | — | 3.7 | 3.3 |
| 11 | Blend | None | — | 2.5 | 1.6 |
| 12 | Blend | Treated | — | 3.1 | 1.7 |

As is seen from the above table, the toner of the invention gives excellent color intensity and uniformity of color, even when the toner was used as a blend. Also, it is found that color intensity and uniformity of color are further improved by the pretreatment of the fabric to be printed.

EXAMPLE 4

A printing plate was prepared by developing an image of stripe patterns with a toner as described in Example 3 but not containing a dye, transfering the toner onto an aluminum plate in the same manner as described in Example 3, and then, fixing the toner by heating at a somewhat high temperature. During the heating, the resin of the toner was welded and formed into film.

The obtained aluminum plate onto which insulating resin layers of welded toner were fixed in stripe patterns was subjected to corona discharge of −6000V to negatively charge the imagewise toner area of the welded resin. Then, the stripe pattern image was developed, with a toner as described in Example 1, Table 1, No. 4, but containing Diacelliton Red R M/D (Mitsubishi Kasei Co., C.I. 11210) as a coloring matter, by magnetic brush method. A polyester fabric was then placed upon the developed surface of the aluminum plate and the red shaded toner was transfered onto the fabric by corona discharge of −6500V from the back surface of the fabric. The toner was fixed onto the fabric using trichlene steam, and then, the dye was fixed and the fabric was washed in the same manner as described in Example 3.

Evaluation results obtained for the fabric are shown in Table 5 below. Results obtained where no triazine derivative was used are also shown in the table.

Table 5

| No. | Coverage of Triazine(%) | Color Intensity | Uniformity of Color |
|---|---|---|---|
| 1 | 9.86 | 4.5 | 4.6 |
| 2 | — | 2.3 | 2.3 |

As is apparent from the above table, the toner of the invention are useful for xeroprinting method.

EXAMPLE 5

In the same manner as described in Example 3, A toner image of stripe patterns was transfered and fixed onto a printing paper in stead of a polyester fabric.

Then, a polyester fabric was placed upon the printed surface of the paper and the stripe patterns were transfer printed by heating at 200° C for 40 seconds on a pantex.

Evaluation results obtained for the printed fabric are shown in Table 6 below. Results obtained where no triazine derivative was used are also shown in the table.

Table 6

| No. | Toner | Coverage of Triazine(%) | Color Intensity | Uniformity of Color |
|---|---|---|---|---|
| 1 | Red | 2.16 | 4.3 | 4.3 |
| 2 | Yellow | 2.08 | 4.2 | 4.2 |
| 3 | Blend | 2.11 (in average) | 4.3 | 4.1 |
| 4 | Red | — | 2.3 | 2.2 |
| 5 | Yellow | — | 2.4 | 2.2 |
| 6 | Blend | — | 2.3 | 1.8 |

As is obvious from the above table, the toner of the invention are useful for a conventional transfer printing.

EXAMPLE 6

A printed fabric was obtained in the same manner as described in Example 1, except that a triazine derivative as shown in Table 13 below was used and a copolymer of styrene and 2-N,N-diethylaminopropyl methacrylate was used as a resin. The evaluation results are shown in Table 7. Evaluation results obtained where no triazine derivative was used are also shown in the table.

Table 7

| No. | Triazine Derivative | Coverage in Average (%) | Uniformity of Color | Stain of Back Surface |
|---|---|---|---|---|
| 1 | 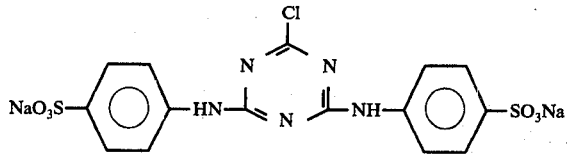 | 1.96 | 4.7 | 4.3 |
| 2 | 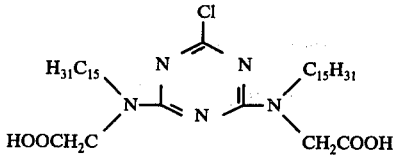 | 2.05 | 4.5 | 4.4 |
| 3 | 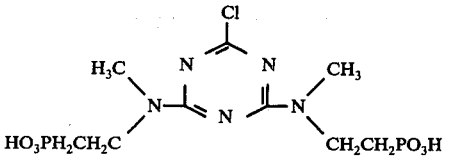 | 1.99 | 4.7 | 4.2 |
| 4 | 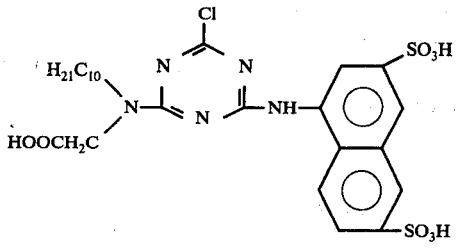 | 2.18 | 4.6 | 4.2 |
| 5 | 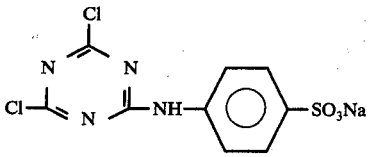 | 1.88 | 4.7 | 4.3 |
| 6 | 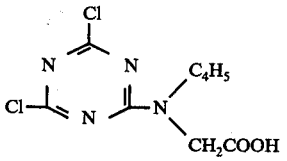 | 2.01 | 4.5 | 4.4 |
| 7 | 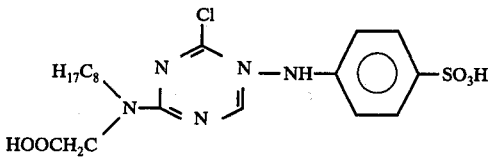 | 1.95 | 4.4 | 4.4 |
| 8 | 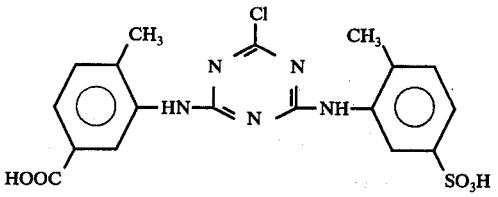 | 1.91 | 4.5 | 4.3 |
| 9 | — | — | 1.3 | 2.7 |

The triazine derivatives used as described above all had an electrification factor within the range mentioned hereinbefore as preferable. From the above table, it is seen that a toner to which has been applied a triazine derivative having such a property is very effective for electrostatic printing.

The same effects were obtained where the triazine derivatives were incorporated in the toner substrate.

EXAMPLE 7

A toner substrate was prepared by blending polystyrene and Diacelliton Fast Scarlet R (a disperse dye from Mitsubishi Kasei Co., C.I. 11150) in a hot roll mill, grinding the blend roughly and then grinding it finely. The toner substrate was dipped into an aqueous solution of a triazine derivative of the formula,

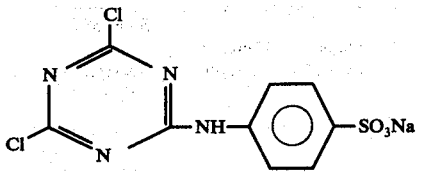

and then filtered and dried. Thus, a toner wherein the triazine derivative was applied to the surface of the toner substrate was obtained.

Then, in the same manner as described in Example 3, a latent image formed on a photosensitive plate consisting of cadmium sulfide and polyethylene terephthalate was developed using a mixture of the toner and iron powder by magnetic brush method, and then transfer printing was repeated in the same manner as described in Example 3. Then, the remaining mixture of the toner and the iron powder was agitated in a current of compressed air, the toner separated was collected and the flowability thereof was determined. The results are shown in Table 8 below.

Table 8

| No. | Repeated No. | Angle of Repose (degree) |
|---|---|---|
| 1. | 0 | 36 |
| 2. | 1000 | 38 |
| 3. | 5000 | 35 |
| 4. | 10000 | 37 |

From the above table, it is apparent that the flowability of the toner to which has been applied a triazine derivative is stable during repeated printing.

What we claim is:

1. A toner for the electrostatic printing of a sheet-like material, which comprises a toner consisting essentially of at least one resin and at least one coloring matter, and a triazine derivative applied to the surface of or incorporated in said toner said triazine derivative being selected from those of the formulae:

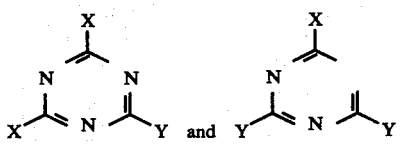

wherein

X is a halogen; and

Y is a radical of the formula:

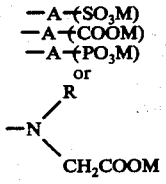

wherein A is

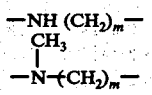

-continued

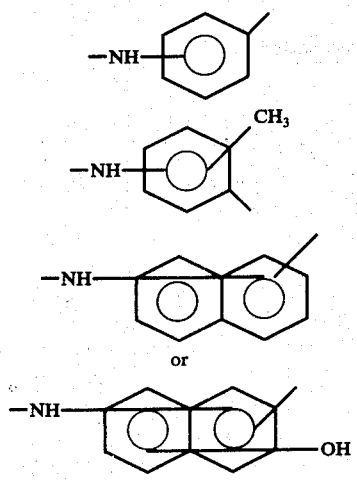

R is hydrogen or alkyl having 1 to 18 carbon atoms;

M is hydrogen or an alkali metal atom;

*m* is an integer of 1 to 5.

2. A toner according to claim 1, wherein said triazine derivative is selected from those consisting of

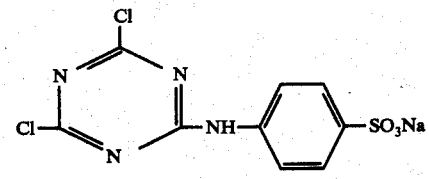

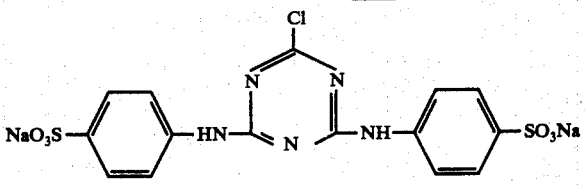

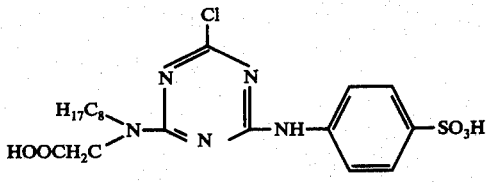

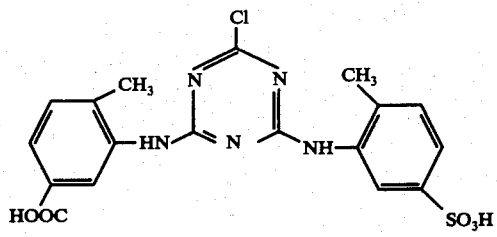

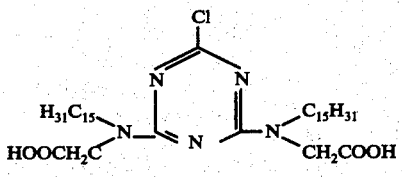

and

-continued

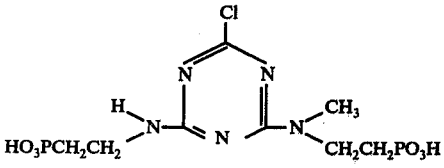

3. A toner according to claim 1, wherein said triazine derivative has an electrification factor of from 100 to 2,000.

4. A toner according to claim 1, wherein said triazine derivative is applied to the toner in an amount of not less than 0.01% based on the weight of said toner.

5. A toner according to claim 1, wherein said triazine derivate is incorporated in the toner in an amount of not less than 0.1% based on the weight of said toner.

6. A toner according to claim 1 having a particle size of less than 80 $\mu$.

* * * * *

UNITED STATES PATENT AND TRADEMARK OFFICE

CERTIFICATE OF CORRECTION

PATENT NO. : 4,085,057
DATED : April 18, 1978

INVENTOR(S) : Yougoro Masuda and Shigeru Kawase

It is certified that error appears in the above-identified patent and that said Letters Patent are hereby corrected as shown below:

Col. 3, lines 20-25, correct formula:

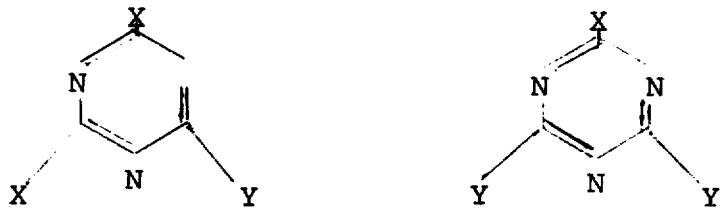

Col. 3, lines 44-45, correct formula:

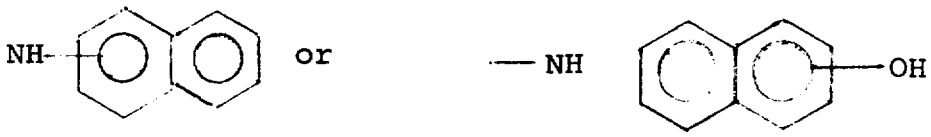

Column 6, line 55, after "of" delete "the"

UNITED STATES PATENT OFFICE
CERTIFICATE OF CORRECTION

Patent No. 4,085,057 Dated April 18, 1978

Inventor(s) Yougoro Masuda and Shigeru Kawase

It is certified that error appears in the above-identified patent and that said Letters Patent are hereby corrected as shown below:

Col. 13, Table 7, Formula #7, change:

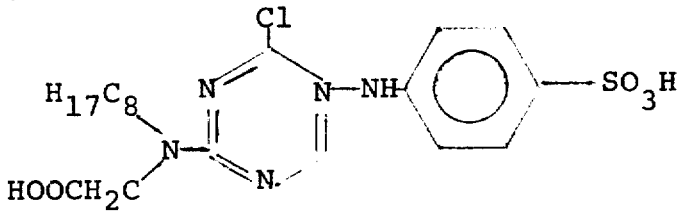

to

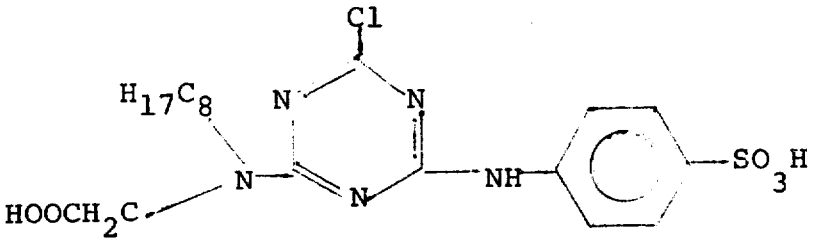

UNITED STATES PATENT OFFICE

CERTIFICATE OF CORRECTION

Patent No. 4,085,057 Dated April 18, 1978

Inventor(s) Yougoro Masuda and Shigeru Kawase

It is certified that error appears in the above-identified patent and that said Letters Patent are hereby corrected as shown below:

Col. 15, lines 45-50, Claim 1, correct formula:

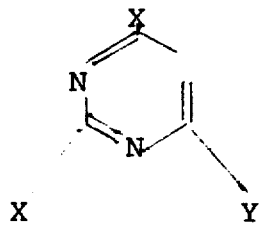

and

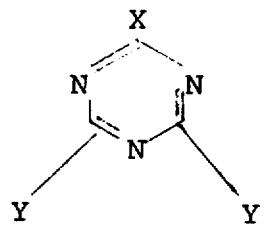

Signed and Sealed this

Third Day of October 1978

[SEAL]

Attest:

RUTH C. MASON
*Attesting Officer*

DONALD W. BANNER
*Commissioner of Patents and Trademarks*